United States Patent [19]

Kelly

[11] Patent Number: 4,674,263

[45] Date of Patent: Jun. 23, 1987

[54] FINGER ASSEMBLY FOR A SCREWCAPPING HEAD

[75] Inventor: Frank M. Kelly, Richmond, Ind.

[73] Assignee: Aluminum Company of America, Pittsburgh, Pa.

[21] Appl. No.: 792,501

[22] Filed: Oct. 29, 1985

[51] Int. Cl.[4] ..... B67B 3/20; B65B 7/28

[52] U.S. Cl. ..... 53/317; 53/331.5

[58] Field of Search ..... 53/317, 331.5, 351, 53/352, 353, 364, 365

[56] References Cited

U.S. PATENT DOCUMENTS

| | | | |
|---|---|---|---|
| Re. 15,612 | 5/1923 | Nordstrom | 53/351 X |
| 1,141,267 | 6/1915 | Ray et al. | 53/351 |
| 2,375,141 | 5/1945 | Shera | 53/351 |
| 3,242,632 | 3/1966 | Dimond | 53/67 |
| 3,434,266 | 3/1969 | Wolf et al. | 53/353 |
| 3,491,516 | 1/1970 | Bergeron | 53/317 |
| 3,537,231 | 11/1970 | Dimond | 53/201 |
| 3,672,121 | 6/1972 | Kawaminani | 53/351 |
| 3,984,965 | 10/1976 | Sonnenberg | 53/331.5 |
| 4,089,153 | 5/1978 | Long | 53/317 X |
| 4,364,218 | 12/1982 | Obrist | 53/331.5 |
| 4,492,068 | 1/1985 | Obrist | 53/331.5 |

OTHER PUBLICATIONS

U.S. application Ser. No. 602,237, Ellis et al., 53/331.005.

*Primary Examiner*—Horace M. Culver
*Attorney, Agent, or Firm*—Thomas J. Connelly

[57] ABSTRACT

A finger assembly for a rotatable screwcapping head which is capable of gripping and screwing a screw closure onto a prethreaded container. The finger assembly includes a guide member which retains at least two fingers pivotally positioned thereon. The fingers have a concave surface which is capable of gripping the screw closure as the fingers are moved to a closed position. A pair of C-shaped retaining rings encompasses both the guide member and the fingers and serves to secure them to the rotatable screwcapping head. The finger assembly also includes an actuator for pivoting the fingers between a closed position wherein the fingers grip the screw closure and an open position wherein the fingers release the screw closure.

19 Claims, 11 Drawing Figures

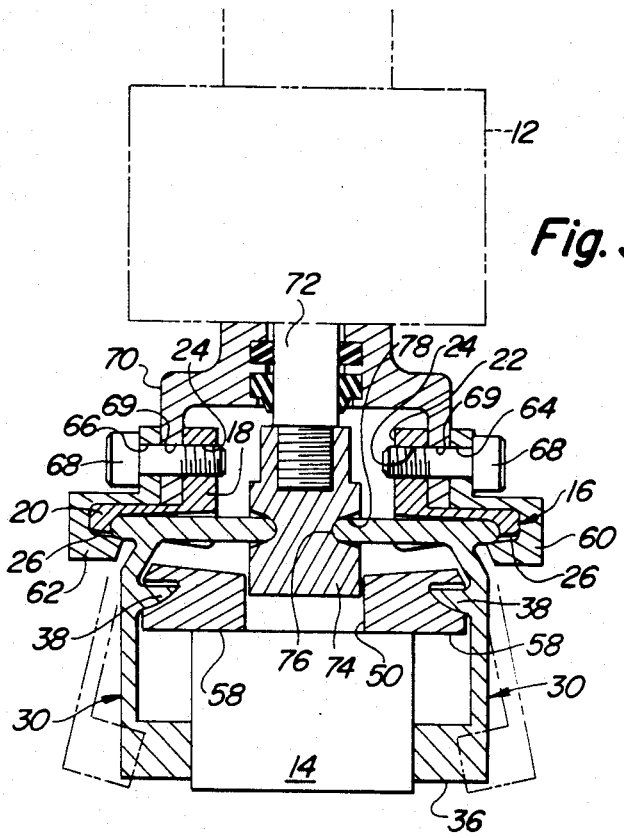
Fig. 3
Fig. 4
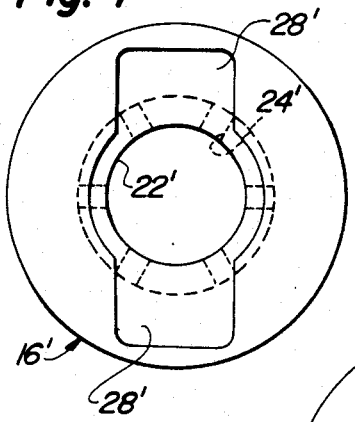
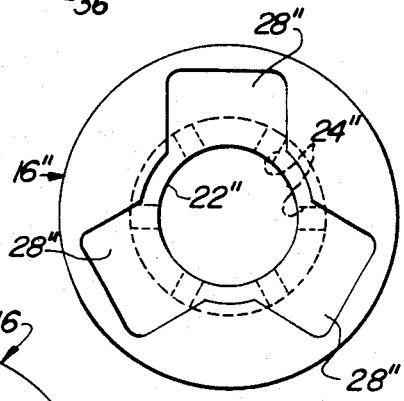
Fig. 5
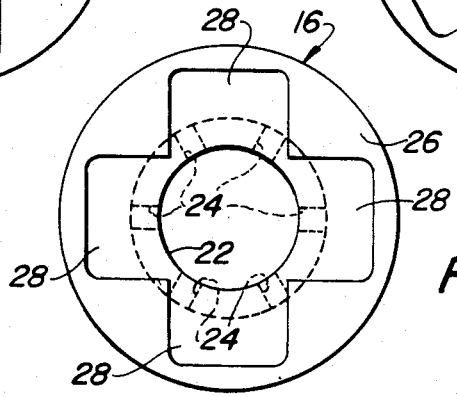
Fig. 6

FINGER ASSEMBLY FOR A SCREWCAPPING HEAD

FIELD OF THE INVENTION

This invention relates to a finger assembly for a screwcapping head which is capable of rapidly gripping and screwing a screw closure onto a prethreaded container.

BACKGROUND OF THE INVENTION

There are various forms of screwcapping machines on the market today which contain chucks designed to screw closures onto a series of containers which are sequentially advanced through the machines. U.S. Pat. Nos. 3,242,632 and 3,491,516 show two such screwcapping machines wherein the chuck is attached to the screwcapping head so as to grip and orient a screw closure relative to a prethreaded container. FIGS. 8 and 5, respectively, of the two above-identified patents show the use of a finger gripping chuck to correctly orient and hold a screw closure. With the advent of new screwcapping machines for more rapidly screwing prethreaded closures onto prethreaded containers, there has arisen a need to design a compatible finger assembly which can rapidly apply the screw closure to a given torque value. Now a finger assembly has been invented which will rapidly grip and screw a prethreaded closure onto a prethreaded container.

SUMMARY OF THE INVENTION

Briefly, this invention relates to a finger assembly for a rotatable screwcapping head which is capable of rapidly gripping and screwing a prethreaded closure onto a prethreaded container. The finger assembly includes a guide member upon which are positioned at least two pivotable fingers, each of which has a concave surface which cooperates with the surface on the other finger to form a gripping mechanism. A retainer is positioned about both the guide member and the fingers and secures both to a screwcapping head for rotation therewith. Lastly, the finger assembly includes an actuator for pivoting the fingers between a closed position wherein the fingers grip a screw closure and an open position wherein the fingers release the screw closure.

The general object of this invention is to provide a finger assembly for a rotatable screwcapping head. A more specific object of this invention is to provide a finger assembly which is capable of rapidly gripping and screwing a screw closure onto a prethreaded container.

Another object of this invention is to provide a finger assembly which is simple in construction, light in weight and economical to build and assemble.

Still further, another object of this invention is to provide a finger assembly which can screw prethreaded closures onto prethreaded containers.

A further object of this invention is to provide a finger assembly for a rotatable screwcapping head which can accommodate closures of various heights.

Other objects and advantages of the present invention will become more apparent to those skilled in the art in view of the following description and the accompanying drawings.

BRIEF DESCRIPTION OF THE DRAWINGS

FIG. 3 is a partial cross-sectional view of the finger assembly taken along line 3—3 of FIG. 1.

FIG. 4 is a top view of a guide member used in the finger assembly showing an elongated recess bifurcated by an axial bore.

FIG. 5 is a top view of a guide member having three equally spaced recesses formed therein.

FIG. 6 is a top view of a guide member having four equally spaced recesses formed therein.

DETAILED DESCRIPTION OF THE PREFERRED EMBODIMENTS

Figure 1:
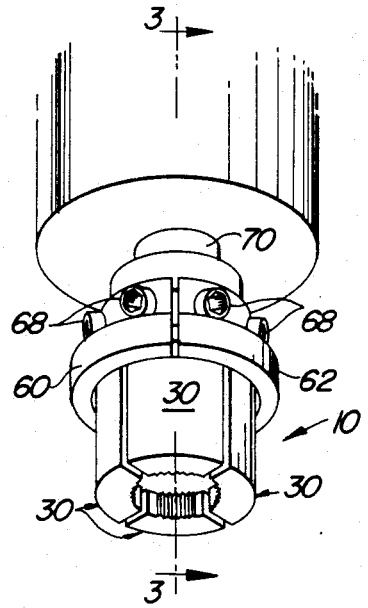
FIG. 1 is an isometric view of a finger assembly attached to a rotatable screwcapping head as viewed from underneath.

Referring to FIG. 1, a finger assembly 10 is shown fastened to a screwcapping head 12. The screwcapping head 12 is designed to rotate and vertically reciprocate on a screwcapping machine (not shown). A typical screwcapping machine has a rotatable turret on which a plurality of screwcapping heads 12 are arranged in a circular fashion and has a conveyor positioned below the turret for sequentially advancing prethreaded containers into alignment with the screwcapping heads. The finger assembly 10 is designed to pick up a screw closure 14 (see FIG. 3), position it over one of the prethreaded containers and screw the closure 14, at a predetermined torque value, onto the container. The finger assembly 10 is especially useful for rapidly gripping and screwing prethreaded metal or plastic closures onto prethreaded glass or plastic bottles.

Referring to FIGS. 2–7, the finger assembly 10 includes a guide member 16 having a first and a second portion 18 and 20, respectively, with an axial bore 22 formed therethrough. The first portion 18 has a smaller diameter than the second portion 20 and contains a plurality of threaded radial bores 24 arranged an equal distance apart about the circumference thereof. The second portion 20 has an end surface 26 which is frustoconical in configuration and which contains at least one recess 28. The recess 28 is roughly one-eighth of an inch deep and cooperates with the frustoconical surface to support fingers 30. The exact number of recesses 28 and their configuration will vary depending upon the number of fingers 30 used in the finger assembly 10. In FIG. 4, a guide member 16' is shown having an elongated recess 28' which is bifurcated by an axial bore 22'. This design is useful when two fingers 30 are utilized in the finger assembly 10. In FIG. 5, an alternative guide member 16'' is shown having three recesses 28'' spaced 120° apart about an axial bore 22''. This design would accommodate three fingers 30. In FIG. 6, the guide member 16 is shown with four recesses 28 arranged 90° out-of-phase with adjacent recesses to provide two pairs of oppositely aligned, intersecting recesses 28. In this situation, four fingers 30 would be used which also would be 90° out-of-phase with the adjoining fingers 30.

Figure 2:
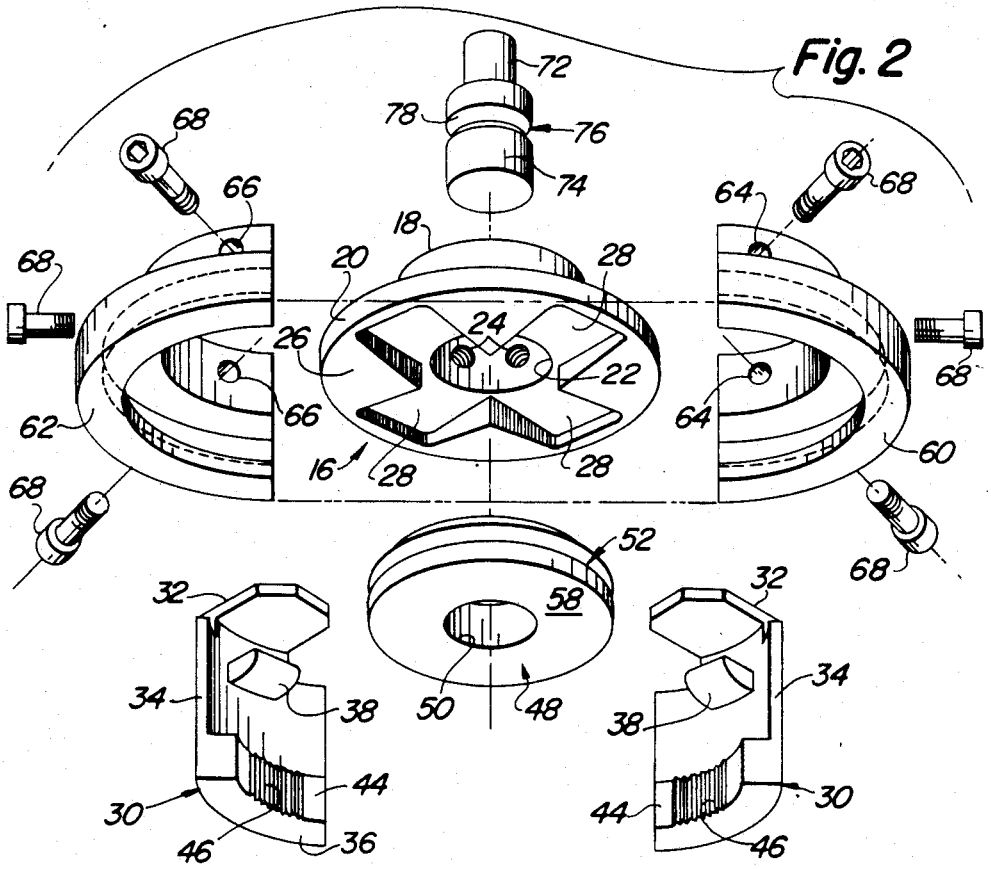
FIG. 2 is an exploded assembly view of the finger assembly shown in FIG. 1.
Figure 7:
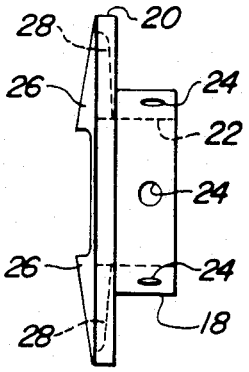
FIG. 7 is a side view of the guide member shown in FIG. 6.
Figure 8:
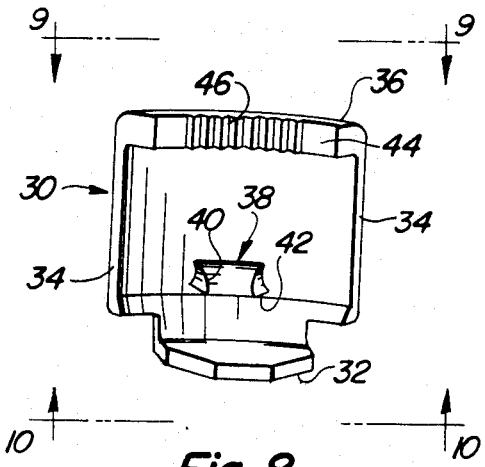
FIG. 8 is an inverted perspective view of one of the fingers used in the finger assembly.
Figure 9:
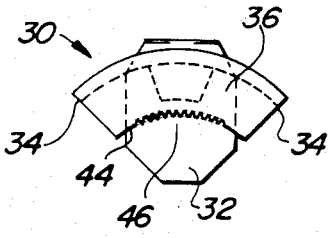
FIG. 9 is a top view of the finger taken along line 9—9 of FIG. 8.
Figure 10:
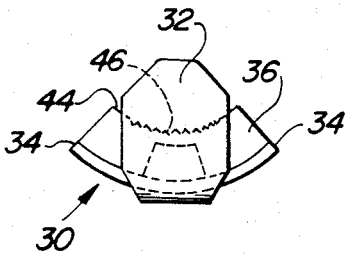
FIG. 10 is a bottom view of the finger taken along line 10—10 of FIG. 8.

Referring to FIGS. 2, 3 and 8–10, the fingers 30, of which there are at least two, and preferably four, are arranged so as to grip the prethreaded screw closure 14. When two fingers 30 are used, they are preferably aligned opposite to one another and in a spaced apart manner. When four fingers 30 are utilized, they are preferably arranged in a circular fashion in the recesses 28. In FIG. 8, the finger 30 has been inverted from its normal operating position just for the purpse of illustration but for the purpose of explanation each finger 30 will be described in its typical operating position as shown in FIG. 2. Each finger 30 includes a flat member 32, an arcuate sidewall 34 which extends downward from the member 32, and an inwardly projecting bottom wall 36. The sidewall 34 has an inwardly projecting tab 38 formed thereon, about one-third of the distance bottom from the member 32, which has a downwardly inclined surface 40 and a flat bottom surface 42. The purpose of the tab 38 will be explained shortly. The top wall 36 contains a concave surface 44 which has a frictional portion 46, such as a serrated surface which matches the particular closure sidewall, which aids in gripping the screw closure 14. The frictional portion 46 can also be a frictional liner made out of a material such as polyurethane. The arc of the concave surface 44 is such that when it combines with the arcs of the adjacent fingers 30 it forms a circle having a diameter approximately equal to the outside diameter of the screw closure 14. This means that if a larger diameter screw closure 14 is to be applied to a prethreaded container, the fingers 30 would have to be replaced with fingers 30 having a longer arc so that the larger screw closure 14 could be accommodated within the circumference of the arcs formed by the closed fingers 30. When four fingers are present, as is shown in FIG. 1, they should be sized such that each finger 30 will abut an adjacent finger on both ends of the sidewall 34 when the fingers 30 are in their closed position. However, when only two or three fingers are present, as is the case when the guide members 16' and 16'' are utilized, the fingers 30 will not touch but should be sized so as to be able to hold the screw closure 14 therebetween.

Figure 11:
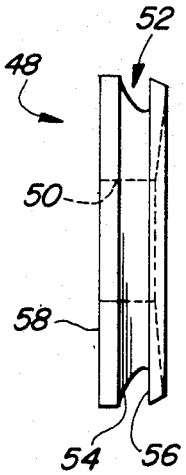
FIG. 11 is a side view of a pressure plate used in the finger assembly.

Referring to FIG. 11, the finger assembly 10 also includes a circular pressure plate 48 having a bore 50 formed therethrough. The pressure plate 48, which is distally spaced from the guide member 16, contains a circumferential slot 52 which is configured and sized to mate with the tabs 38 formed on the fingers 30. The circumferential slot 52 contains an inclined arcuate surface 54 which intersects with a flat surface 56. Preferably, the slot 52 is slightly larger than the tabs 38. The pressure plate 48 is designed to be inserted within the fingers 30 so that its bottom surface 58 will serve as a stop for the screw closure 14 (see FIG. 3). It is advantageous to size the circumferential slot 52 larger than the tabs 38 to permit the pressure plate 48 to float sideways as the fingers 30 pivot from their closed position, shown by solid lines in FIG. 3, to their open position, shown by dotted lines in FIG. 3. The insertion of the tabs 38 into the circumferential slot 58 assures that the pressure plate 48 will remain essentially stationary in the axial direction as the fingers 30 open and close. This is important because the pressure plate 48 has to provide a similar stop for each of the screw closures 14 regardless of the position of the fingers 30.

Referring again to FIGS. 2 and 3, the finger assembly 10 is held together by a pair of C-shaped retaining rings 60 and 62 which are sized to surround the first and second portions 18 and 20 of the guide member 16. The C-shaped retaining rings 60 and 62 contain an equal number of radial bores 64 and 66, respectively, which align with the threaded radial bores 24 formed in the guide member 16. The retaining rings 60 and 62 are fastened to the guide member 16 by a plurality of cap screws 68. As best seen in FIG. 3, the cap screws 68 pass through the bores 64 and 66 of the retaining rings 60 and 62 and through bores 69 formed in a carrier assembly 70 and then into the threaded radial bores 24. The carrier assembly 70 is permanently attached to the screwcapping head 12.

In order to actuate the pivotal movement of the fingers 30, a rod 72 having a nut 74 attached to an end thereof is positioned within the axial bores 22 and 50 of the guide member 16 and the pressure plate 48, respectively. The rod 72 is moved axially through the bores 22 and 50 by hydraulic, pneumatic or electrical power supplied from a control mechanism (not shown). Such a control mechanism is shown in U.S. patent application Ser. No. 792,579, filed Oct. 29, 1985, and assigned to Aluminum Company of America. This patent application is incorporated by reference and made a part hereof. The nut 74 contains a circular groove 76 having an outwardly extending inclined surface 78. The groove 76 receives the flat member 32 of each finger 30, and the inclined surface 78 allows the fingers 30 to pivot to an open position, shown by the dotted lines in FIG. 3, as the rod 72 and the nut 74 move downward. The inclined surface 78 allows the fingers 30 to pivot, without binding, as the nut 74 moves axially into the bore 50 of the pressure plate 48. As is seen in FIG. 3, the fingers 30 are prevented from moving away from or from falling out of the recesses 28 by the retaining rings 60 and 62.

OPERATION

The operation of the finger assembly 10 will be explained in reference to FIG. 3, which in normal use is oriented in the vertical plane above the closure 14. The rod 72 will move downward at a selected time to cause the fingers 30 to pivot outwardly relative to the guide member 16. The finger assembly 10 will then be lowered down around the screw closure 14 until the closures upper surface abuts the bottom surface 58 of the pressure plate 48. The rod 72 is then moved upward by a hydraulic, pneumatic or electrical control causing the fingers 30 to grip the screw closure 14 and rotate it at the speed of the screwcapping head 12. The entire finger assembly 10 will then be moved into position over a prethreaded container and the closure 14 will be lowered and threaded onto the container. The finger assembly 10 will move further downward to compensate for the engagement and take-up of the threads as the closure 14 is threaded onto the container. Once the screw closure 14 has been tightened onto the container at a predetermined torque value, the rod 72 will again move downward causing the fingers 30 to pivot to their open position. This action causes the concave surfaces 44 to move away from the screw closure 14 so that the entire screwcapping head 12 can move up and away from the capped container. The screwcapping head 12 and the finger assembly 10 will then be rotated into a position to repeat the operation with a new screw closure 14 on a new container.

While the invention has been described in conjunction with three specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A finger assembly for a rotatable screwcapping head which is capable of gripping and screwing a screw closure onto a prethreaded container, said finger assembly comprising:

(a) a guide member having at least one recess formed in an end thereof and having an axial bore formed therethrough;

(b) at least two fingers pivotally positioned in said recess of said guide member which extend downward and out of said guide member, each having a concave surface, said fingers cooperating with each other to grip said screw closure;

(c) retaining means for attaching said guide member and said fingers to said screwcapping head for rotation therewith; and (d) actuation means for pivoting said fingers between a closed position wherein said fingers grip said screw closure and an open position wherein said fingers release said screw closure.

2. The finger assembly of claim 1 wherein each of said fingers includes a flat member, a sidewall extending downward from said flat member and a bottom wall projecting inward from said sidewall, said bottom wall containing said concave surface.

3. The finger assembly of claim 1 wheren said concave surface is at least partially serrated.

4. The finger assembly of claim 1 wherein said guide member has an axial bore formed therethrough and said actuation means includes a movable rod extending into said axial bore and connected to said fingers to cause pivotable actuation thereof.

5. A finger assembly for a rotatable screwcapping head which is capable of gripping and screwing a screw closure onto a prethreaded container, said finger assembly comprising:

(a) a guide member having a pair of intersecting recesses formed in an end thereof and having an axial bore formed therethrough;

(b) four fingers arranged in a circular fashion on said guide member and pivotally positioned in said recesses, each having a frictional concave surface, said fingers cooperating with each other to grip said screw closure;

(c) a pair of C-shaped retaining means for securing said guide member and said fingers to said screwcapping head for rotation therewith; and (d) a movable rod extending out of said screwcapping head and into said axial bore formed in said guide member and secured to said fingers, axial movement of said rod causing said fingers to pivot within said recesses between a closed position wherein said fingers grip said screw closure and an open position wherein said fingers release said screw closure.

6. The finger assembly of claim 5 wherein a pressure plate having a circumferential slot formed therein is positioned within said circularly arranged fingers.

7. The finger assembly of claim 6 wherein each of said fingers contains a tab formed on an inner surface thereof which engages said circumferential slot formed in said pressure plate to hold said pressure plate in position.

8. The finger assembly of claim 5 wherein each finger includes a flat member, an arcuate sidewall extending downward from said flat member and a bottom wall projecting inward from said sidewall, said bottom wall containing said serrated concave surface.

9. The finger assembly of claim 8 wherein said four fingers are 90° out-of-phase with adjacent fingers.

10. The finger assembly of claim 5 wherein said frictional surface is a serrated concave surface.

11. A finger assembly for a rotatable screwcapping head which is capable of gripping and screwing a prethreaded closure onto a prethreaded container, said finger assembly comprising:

(a) a disc-shaped guide member having first and second portions with an axial bore formed therethrough, said first portion having a plurality of threaded radial bores formed therein and said second portion having a larger diameter than said first portion and having four recesses formed in an end thereof;

(b) fingers arranged in a circular fashion and pivotally positioned in each of said recesses, each of said fingers having a flat member, an arcuate sidewall extending downward from said flat member and having a tab formed on an inner surface thereof, and a bottom wall projecting inward from said sidewall, said bottom wall containing a serrated concave surface, said fingers cooperating with each other to grip said screw closure;

(c) a pressure plate positioned within said fingers having a circumferential slot formed therein which receives said tabs, said pressure plate serving as a stop for said screw closure;

(d) a pair of C-shaped retaining rings encircling said guide member and holding said fingers thereto, each ring having a number of radial bores formed therein which align with said threaded radial bores formed in said first portion of said guide member;

(e) attachment means for securing said pair of retaining rings and said guide member to said screwcapping head for rotation therewith; and (f) actuation means for pivotally moving said fingers relative to said guide member between a closed position wherein said fingers grip said screw closure and an open position wherein said fingers release said screw closure.

12. The finger assembly of claim 11 wherein said actuation means includes a movable rod extending out of said screwcapping head and into said axial bore formed in said guide member and secured to said flat member of said fingers, axial movement of said rod causing said fingers to pivot within said respective recesses.

13. The finger assembly of claim 11 wherein there are four fingers, each oppositely aligned to another one of said fingers.

14. The finger assembly of claim 12 wherein each of said fingers contacts two adjacent fingers in said closed position.

15. The finger assembly of claim 11 wherein said tabs on said fingers have a downwardly inclined surface and a flat top surface and said circumferential slot formed in said pressure plate has a similar configuration which permits said fingers to pivot outward to said open position without axially moving said pressure plate.

16. The finger assembly of claim 11 wherein said pressure plate is distally spaced away from said guide member.

17. A finger assembly for a rotatable screwcapping head which is capable of gripping and screwing a screw closure onto a prethreaded container, said finger assembly comprising:

(a) a guide member;

(b) at least two fingers pivotally positioned on said guide member, each having a concave surface, said fingers cooperating with eabh other to grip said screw closure;

(c) a pair of C-shaped retaining means for attaching said guide member and said fingers to said screw-capping head for rotation therewith; and (d) actuation means for pivoting said fingers between a closed position wherein said fingers grip said screw closure and an open position wherein said fingers release said screw closure.

18. The finger assembly of claim 17 wherein each of said fingers includes a flat member, a sidewall extending downward from said flat member and a bottom wall projecting inward from said sidewall, said bottom wall containing said concave surface.

19. The finger assembly of claim 17 wherein said concave surface is at least partially serrated.

* * * * *

UNITED STATES PATENT AND TRADEMARK OFFICE

CERTIFICATE OF CORRECTION

PATENT NO. : 4,674,263

DATED : June 23, 1987

INVENTOR(S) : Frank M. Kelly

It is certified that error appears in the above-identified patent and that said Letters Patent is hereby corrected as shown below:

| | |
|---|---|
| Col. 3, line 20 | Delete "bottom". |
| Col. 3, line 21 | Change "bottom" to --top--. |
| Col. 3, line 22 | Change "top" to --bottom--. |
| Claim 17, Col. 7, line 14 | Change "eabh" to --each--. |

Signed and Sealed this

Fifteenth Day of December, 1987

*Attest:*

DONALD J. QUIGG

*Attesting Officer*

*Commissioner of Patents and Trademarks*